US007352345B2

(12) United States Patent
Li

(10) Patent No.: US 7,352,345 B2
(45) Date of Patent: Apr. 1, 2008

(54) DRIVING APPARATUS AND METHOD FOR LIGHT EMITTING DIODE DISPLAY

(75) Inventor: Chun-huai Li, Wandan Township, Pingtung County (TW)

(73) Assignee: AU Optronics Corporation, Hsinchu (TW)

( * ) Notice: Subject to any disclaimer, the term of this patent is extended or adjusted under 35 U.S.C. 154(b) by 737 days.

(21) Appl. No.: 10/839,260

(22) Filed: May 6, 2004

(65) Prior Publication Data

US 2005/0248516 A1 Nov. 10, 2005

(51) Int. Cl.
*G09G 3/30* (2006.01)

(52) U.S. Cl. ..... 345/76; 345/211; 345/212; 345/214

(58) Field of Classification Search ..... 345/76, 345/211, 214, 212
See application file for complete search history.

(56) References Cited

U.S. PATENT DOCUMENTS 6,518,962 B2 * 2/2003 Kimura et al. ..... 345/211

FOREIGN PATENT DOCUMENTS

JP 2003-150108 5/2003

* cited by examiner

*Primary Examiner*—Richard Hjerpe
*Assistant Examiner*—Leonid Shapiro
(74) *Attorney, Agent, or Firm*—Arent Fox LLP

(57) ABSTRACT

The present invention provides a driving apparatus, method and system for a light emitting device, suitable for use in an active matrix organic light emitting diode (AMOLED) display, which has an adjustable reference voltage, so as to compensate for degradation in brightness due to LED materials decay.

6 Claims, 5 Drawing Sheets

DRIVING APPARATUS AND METHOD FOR LIGHT EMITTING DIODE DISPLAY

BACKGROUND OF THE INVENTION

1. Field of Invention

The present invention relates to a technique for driving a light emitting device (LED), and suitable for an active matrix organic light-emitting diode (AMOLED). In particular, the present invention is directed to a technique for driving a light emitting device, and suitable for an active matrix organic light-emitting diode (AMOLED), such that the brightness of the display will not degrade as normal degradation of the materials occurs.

2. Description of Related Art

The active matrix organic light emitting diode (AMOLED) display technology is a newly developed technology, and will be mainstream for display devices accompanying liquid crystal displays (LCDs) in the future. The major feature of the AMOLED display is the use of a thin film transistor (TFT) technique to drive the organic light emitting diode, and the driving integrated circuit (IC) is installed on the panel directly, so as to be small in volume and low in cost. The AMOLED display can be applied on a medium or small sized panel in a cellular phone, PDA, digital camera and palm game player, portable DVD player and automobile global positioning system.

The digital display is characterized by a display screen composed of multiple pixels in a matrix arrangement. In order to control individual pixels, a specific pixel is commonly selected via a scanning line and a data line, and an appropriate operating voltage is also provided, so as to display information corresponding to this pixel.

In order to create an AMOLED display, a TFT substrate and organic light-emitting diode (OLED) film are incorporated into the AMOLED display pixels. When the TFT and OLED degrade, the entire display degrades as well. One approach suggests that the design of the pixels must be geared towards compensating for the degradation of the TFT, i.e., towards compensating for the shift in the threshold voltage in order for the electric current produced by the TFT to be preserved. Judging from the current technology, however, the brightness of the OLED cannot be maintained, even if the electric currents provided by the TFT are kept constant. This is because the efficiency of the OLED itself declines with time, and it declines faster than the TFT. Therefore, according to conventional techniques, even when electric currents are kept steady by the TFT, the brightness of the AMOLED display still decays.

According to FIG. 1, the brightness of the OLED depends upon the electric current, I, supplied by the TFT substrate and the OLED's own efficiency, E:

$$B=E\,J=E\,I/A \tag{1}$$

The power of the electric current created by the TFT substrate, however, is determined by the voltage, $V_{gs}$, provided by the data driver and the threshold voltage, $V_t$, of the TFT:

$$I=k\,(V_{gs}-V_t)^2 \tag{2}$$

The decay of the TFT is reflected in $V_t$, namely, decay of the TFT results in an increase in $V_t$, which causes a decrease in I. Usual practice, therefore, would be to compensate for the increase in $V_t$ or to use a constant current data driver to keep the electric current constant. However, even with constant electric current, as can be seen from formula (1) above, the display's brightness will decline with the efficiency (E), which decays with time. This is a serious problem.

A second problem occurs when the display is stationary for some time. When this happens, the area being displayed decays at a faster rate than other areas. When this occurs, different brightness levels on the display will result in residual images remaining from the previous display.

In order to overcome these problems, what is needed is a circuit and method for maintaining a constant brightness to an OLED display, which accounts for more than just the change in $V_t$, but also compensates for degradation in the efficiency, thus addressing and solving problems associated with conventional systems.

SUMMARY OF THE INVENTION

The present invention provides a driving circuit for an LED, suitable for use in a AMOLED display, which has an adjustable reference voltage, so as to compensate for degradation in brightness due to material decay. The driving circuit includes a driving circuit main part which includes a light emitting device driven by a driving transistor as well as a scan line connection terminal, a data line connection terminal, and an adjustable reference voltage. The driving transistor has a gate connected to a first node, a source connected to a system high voltage and a drain connected to a second node, the second node also being connected to the anode of the LED. A first transistor has a gate connected to the scan line connection terminal, a source connected to the data line connection terminal, and a drain connected to a third node. A second transistor has a gate electrode connected to the gate of the first transistor, a source connected to the third node, and a drain connected to the first node. A third transistor has a gate electrode connected to the second node, a source connected to an adjustable reference voltage, and a drain connected to the third node. A capacitor is connected between the first node and the system high voltage.

The principle of this invention is to measure the level of the LED material's decay, which will be sent to the TFT substrate. The TFT substrate, in return, will increase the electric current to areas of decay in order to maintain the original brightness.

It is an object of the present invention to measure the extent to which LED material in general, and OLED film in particular, has decayed.

It is another object of the present invention to compensate for LED material decay and preserve the brightness by furnishing the display with stronger electric currents, rather than simply keeping electric currents constant.

It is a further object of the present invention to compensate for the difference between pixels instead of compensating for the entire display. In so doing, the overtime brightness pattern of some pixels can be solved, and thereby prevent spoiling the entire display.

An advantage of the present invention is the preservation of LED brightness in spite of routine decay of LED material.

A further advantage of the present invention is the prevention of overtime brightness patterns due to inter-pixel inconsistencies.

These and other objects and advantages of the present invention will be fully apparent from the following description, when taken in connection with the annexed drawings.

DESCRIPTION OF THE DRAWINGS

The accompanying drawings, which are included to provide a further understanding of the present invention and are incorporated in and constitute a part of this specification, illustrate examples of the present invention and together with the description serve to explain the principles of the present invention.

In the drawings.

DETAILED DESCRIPTION OF THE EXEMPLARY EMBODIMENTS

Reference will now be made in detail to the exemplary embodiments of the present invention, examples of which are illustrated in the accompanying drawings.

The present invention relates to an improved circuit and method for compensating for decreased brightness due to degradation in the materials for an LED.

Figure 1:
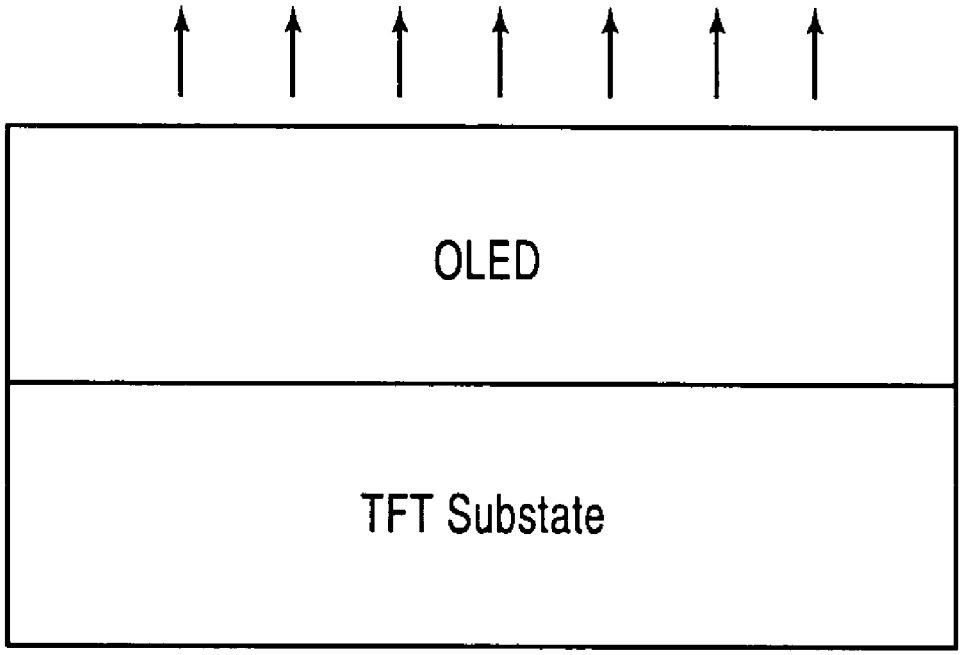
Fig.1 (Prior Art)
FIG. 1 is a conceptual depiction of a conventional AMOLED.
Figure 2:
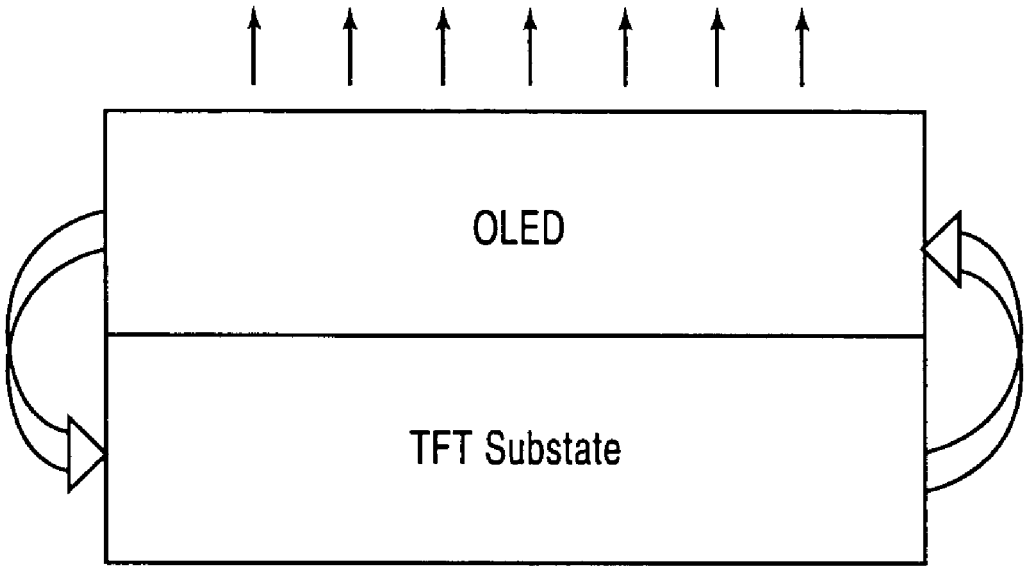
FIG. 2 is a conceptual depiction of the present invention.

As shown in FIG. 2, the principle of this invention is to measure the level of LED materials decay, which will be sent to the TFT substrate. The TFT substrate, in return, will increase the electric current to areas of decay in order to maintain its original brightness. A more detailed description follows.

Figure 3:
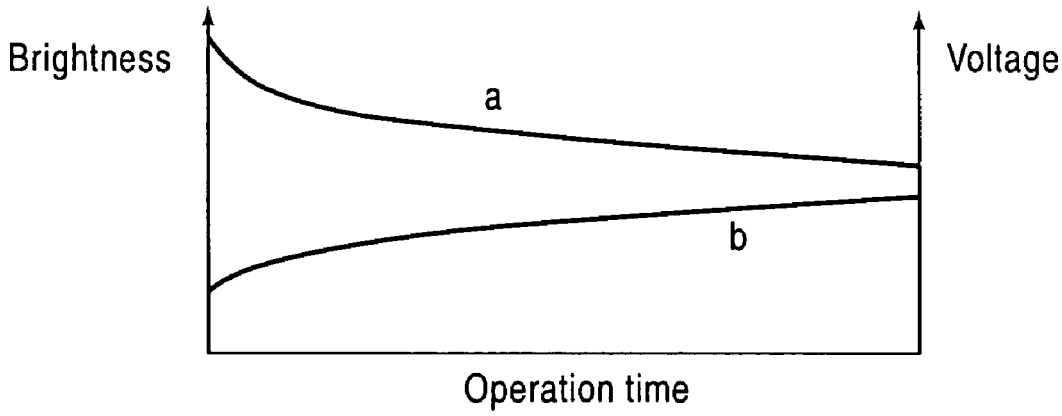
FIG. 3 illustrates general behavior of brightness and voltage according to operation time for a light emitting device.

In FIG. 3, we see that because LED material decay (curve a) coincides with an increase in the LED's threshold voltage, there are two ways to measure LED material's decay. The first one is to ascertain the brightness of LED, and the second one is to determine the LED's threshold voltage. The present invention takes the second approach, that is, it determines the LED threshold voltage.

Figure 4:
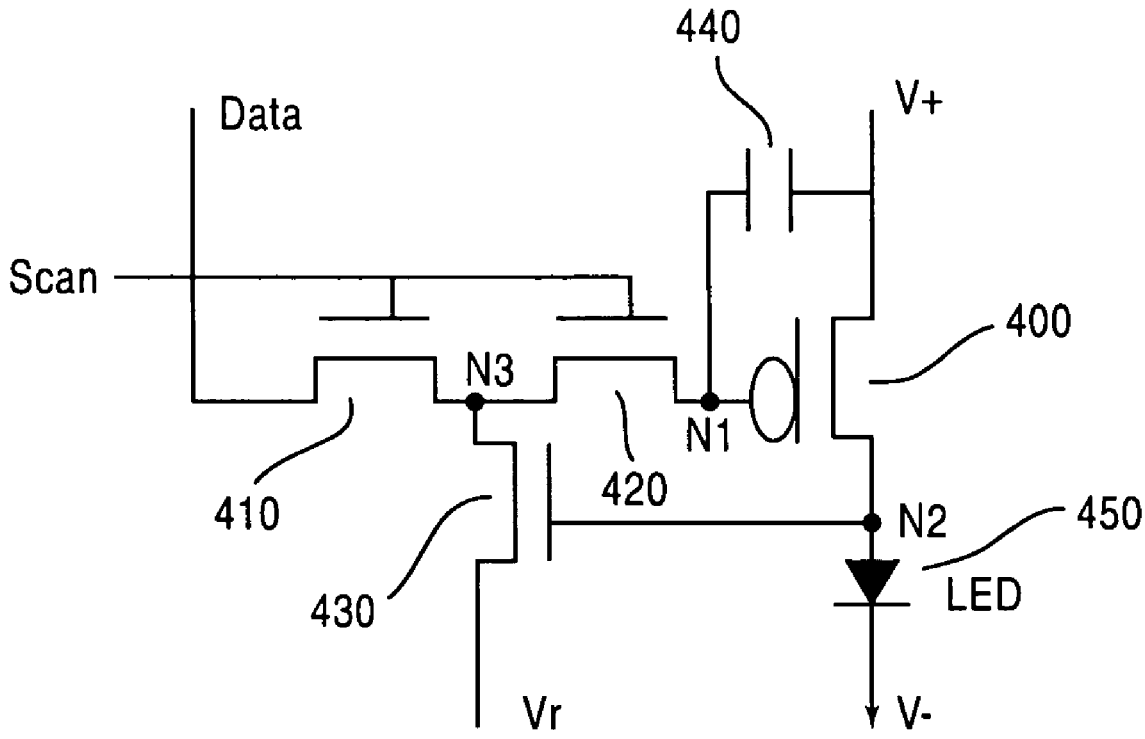
FIG. 4 illustrates an example of an embodiment of the driving circuit according to the present invention.

Referring to FIG. 4, the driving circuit comprises a main or driving transistor 400, which may be a thin film transistor (TFT). The gate of transistor 400 connects to node N1, the source of transistor 400 connects to a system high voltage, and the drain of transistor 400 connects to node N2 which also serves as the anode for the LED. Generally speaking, the source and the drain of the transistor are swappable, the case shown in FIG. 4 being for illustrative purposes only, and is not meant to limit the scope of the invention. Transistor 410 has a gate connected to the scan line connection terminal, a source connected to the data line connection terminal, and a drain connected to a node N3. Transistor 420 has a gate electrode connected to the gate of transistor 410, a source connected to node N3, and a drain connected to node N1. A third transistor 430 has a gate electrode connected to node N2, a source connected to an adjustable reference voltage, and a drain connected to node N3. A capacitor is connected between node N1 and the system high voltage.

The principle of operation of the driving circuit shown in FIG. 4 is described as follows. When the gates of the transistors 410 and 420 are activated by receiving the $V_{scan}$ provided by the scanning line, the data voltage $V_{data}$ is input into the source of the transistors 410 and 420. Meanwhile, the system high voltage source V+ flows into the light emitting device 450 via transistor 400, so as to cause light emission. The system high voltage source $V_+$ flows into capacitor 440, which connected at its other end into node N1, which further connects to the gate of transistor 400 and the drain of transistor 420. The source of transistor 420 is a node N3 which is shared between the drain of transistor 410, and the drain of transistor 430. Transistor 430 has a gate connected to the anode of the LED, and a source connected to a reference voltage $V_r$.

Conventionally, when the LED 450 is activated for a long time, its efficiency decreases accordingly. That means even LED 450 is supplied the same electrical current, the brightness and voltage drop of LED 450 decreases with operating time.

However, in the present invention, when the scan line is turned on, the value of $V_{N3}$ is equal to that of $V_{data}$ and $V_r$'s separate voltages. The values of these separate voltages are determined by the resistance of both transistor 410 and transistor 430. When LED's voltage increases, $V_{N2}$ will increase. Therefore, transistor 430's voltage $V_{gs}$ will increase, and $R_{430}$ will decrease. According to formula (3) below:

$$V_{N3}=(R_{430}\ V_{data}+R_{410}\ V_r)/(R_{430}+R_{410}), \tag{3}$$

when $R_{430}$ decreases, $V_{N3}$ will approach $V_r$. As illustrated by transistor 400 being a P type TFT, $V_r$'s reference voltage must be lower than that of $V_{data}$. Therefore, when $V_{N2}$'s voltage increases, $V_{N3}$ will decrease. Transistor 400's $V_{gs}$ will increase, and the current that goes through transistor 400 will increase. In other words, the electric current passing through the LED will increase. (Note that for the case in which the driving transistor 400 is a N-type TFT, $V_r$ must be higher than that of $V_{data}$.)

Figure 5:
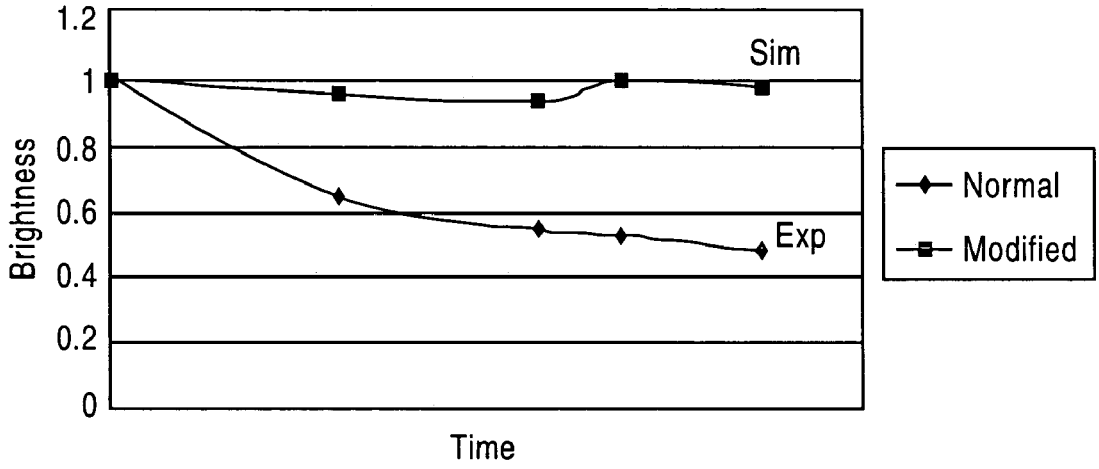
FIG. 5 illustrates simulation results for an embodiment of the present invention.

In order to compensate for this increase, according to the simulation results shown in FIG. 5, when $V_+$=7 V, $V_-$=−7 V, $V_{scan}$=9 V, $V_{data}$=O V, different levels of compensating electric currents will respond to different $V_r$. Due to variations in materials, LED will result in different curve depicting different voltage behaviors. The value of $V_r$, in this case, can be adjusted to fit the rising curve of LED's voltage to fit different characteristics of different materials.

FIG. 5 illustrates the actual longevity of the materials. As shown by the simulated longevity in the present application, even when the brightness reduces to 50% due to materials decay, the brightness can be kept at 98% when this technique is applied.

One of the major characteristics of the present invention is providing a driving circuit for the light emitting device, able to avoid the deviation of the brightness of the light emitting device. In particular, the example of FIG. 4 avoids the deviation of the current through the driving transistor 400 and the current through the light emitting device 450, wherein the deviation occurs as the display operational time increases. The driving circuit for the light emitting device provided by the present invention at least can maintain the current on a stable value even under a long operational time, so as to efficiently improve the display product quality.

It will be apparent to those skilled in the art that various modifications and variations can be made to the apparatus and method for driving a flat panel display device of the present application without departing from the spirit or scope of the invention. Thus, it is intended that the present invention covers the modifications and variations of this invention provided they come within the scope of the appended claims and their equivalents.

What is claimed is:

1. A driving apparatus for a light emitting device, which has an adjustable input reference voltage, the driving apparatus comprising:

a driving transistor, having a gate connected to a first node;

the light emitting device, serially connected to the driving transistor at a second node, so as to constitute a light emitting path, wherein, the light emitting path is connected in between a system high voltage and a system low voltage, such that when the driving transistor is activated, the system high voltage drives the light emitting device to make it emit the light;

a maintain capacitor, connected to the first node and to the system high voltage, a first transistor, having a gate connected to a scanning line, a source connected to a data line, and a drain connected to a third node;

a second transistor, having a gate connected to the scanning line, a source connected to the third node, and a drain connected to the first node;

a third transistor, having a gate connected to the second node, a source connected to an adjustable reference voltage, and a drain connected to the third node.

2. The driving apparatus of claim 1, wherein, when the resistance of the LED increases, the voltage at the third node decreases toward a value approaching that of the reference voltage, so as to cause the current through the driving transistor and the light emitting device to increase, and thus for the LED to maintain its original brightness value.

3. The driving apparatus of claim 2, wherein the system high voltage level is a first predetermined voltage, the system low voltage level is a second predetermined voltage, the scanning line voltage is a third predetermined voltage, the data line voltage is a fourth predetermined voltage, and the reference voltage is a fifth predetermined voltage.

4. The driving apparatus of claim 3, wherein when the driving transistor is P-type, the reference voltage is set less than the data line voltage.

5. The driving apparatus of claim 3, wherein when the driving transistor is N-type, the reference voltage is set greater than the data line voltage.

6. The driving apparatus of claim 2, wherein the light emitting device comprises an organic light emitting diode.

* * * * *